US009033542B2

(12) United States Patent
Peck et al.

(10) Patent No.: US 9,033,542 B2
(45) Date of Patent: May 19, 2015

(54) LED LUMINAIRE UTILIZING AN EXTENDED AND NON-METALLIC ENCLOSURE

(75) Inventors: John Patrick Peck, Manasquan, NJ (US); Aleksandr Olegovich Spiridonov, Allentown, NJ (US); Samual David Boege, Point Pleasant, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 13/177,239

(22) Filed: Jul. 6, 2011

(65) Prior Publication Data

US 2012/0120653 A1 May 17, 2012

Related U.S. Application Data

(63) Continuation-in-part of application No. 12/947,239, filed on Nov. 16, 2010.

(51) Int. Cl.
*F21S 4/00* (2006.01)
*F21S 8/06* (2006.01)
(Continued)

(52) U.S. Cl.
CPC .. *F21S 8/06* (2013.01); *F21V 27/02* (2013.01); *F21V 3/0436* (2013.01); *F21V 13/04* (2013.01); *F21V 17/104* (2013.01); *F21V 19/004* (2013.01);
(Continued)

(58) Field of Classification Search
CPC ..... F21S 8/06; F21V 13/04; F21V 27/02; F21V 17/04; F21Y 2101/02
USPC ..... 362/222, 217.05, 217.12, 311.02, 362/311.15, 362, 217.01, 223, 235, 249.02, 362/267, 311.04, 311.06
See application file for complete search history.

(56) References Cited

U.S. PATENT DOCUMENTS 4,238,815 A 12/1980 Price
5,032,960 A 7/1991 Katoh
(Continued)

FOREIGN PATENT DOCUMENTS

AT 110430 U1 10/2010
DE 10 2006 031345 A1 1/2008
(Continued)

OTHER PUBLICATIONS

International Search Report and Written Opinion for PCT/US2011/060797, Mar. 9, 2012, -copy consists of 8 unnumbered pages.
(Continued)

*Primary Examiner* — Jong-Suk (James) Lee
*Assistant Examiner* — Leah S Macchiarolo

(57) ABSTRACT

The present disclosure relates generally to a light emitting diode (LED) luminaire. In one embodiment, the LED luminaire includes a linearly extended enclosure having an interior volume, one or more sides and a light exiting portion along a length of the linearly extended enclosure, wherein the one or more sides each comprise an inside surface and an outside surface, wherein at least a portion of the linearly extended enclosure comprises an extruded optically clear plastic, one or more first LEDs mounted on the inside surface of the one or more sides of the linearly extended enclosure and a reflector coupled to the interior volume of the linearly extended enclosure, wherein the reflector redirects light from the one or more first LEDs.

18 Claims, 14 Drawing Sheets

(51) Int. Cl.

| | |
|---|---|
| ***F21V 3/04*** | (2006.01) |
| ***F21V 13/04*** | (2006.01) |
| *F21V 27/02* | (2006.01) |
| *F21V 17/10* | (2006.01) |
| *F21V 19/00* | (2006.01) |
| *F21Y 101/02* | (2006.01) |
| *F21Y 103/00* | (2006.01) |

(52) U.S. Cl.
CPC ..... *F21Y 2101/02* (2013.01); *F21Y 2103/003* (2013.01)

(56) References Cited

U.S. PATENT DOCUMENTS

| | | | | |
|---|---|---|---|---|
| 5,365,411 | A | 11/1994 | Rycroft et al. | |
| 5,499,170 | A * | 3/1996 | Gagne | 362/84 |
| 5,848,837 | A * | 12/1998 | Gustafson | 362/235 |
| 6,481,868 | B1 * | 11/2002 | Lin | 362/247 |
| 6,739,734 | B1 | 5/2004 | Hulgan | |
| 7,144,139 | B2 * | 12/2006 | Kramer et al. | 362/368 |
| 7,553,051 | B2 | 6/2009 | Brass et al. | |
| 7,588,347 | B1 | 9/2009 | Edwards, Jr. | |
| 7,658,513 | B2 | 2/2010 | Peck | |
| 7,926,975 | B2 | 4/2011 | Siemiet et al. | |
| 8,220,977 | B2 * | 7/2012 | Fugerer et al. | 362/373 |
| 2003/0095404 | A1 | 5/2003 | Becks et al. | |
| 2003/0103347 | A1 | 6/2003 | Friend | |
| 2003/1223235 | | 12/2003 | Mohacsi Ferenc et al. | |
| 2004/0004827 | A1 | 1/2004 | Guest | |
| 2005/0180135 | A1 | 8/2005 | Mayer et al. | |
| 2005/0201098 | A1 | 9/2005 | DiPenti et al. | |
| 2005/0259424 | A1 | 11/2005 | Zampini | |
| 2008/0219002 | A1 | 9/2008 | Sommers | |
| 2008/0259601 | A1 * | 10/2008 | Frank et al. | 362/240 |
| 2009/0002988 | A1 * | 1/2009 | Kim et al. | 362/247 |
| 2010/0039813 | A1 | 2/2010 | Sloan et al. | |
| 2010/0103679 | A1 | 4/2010 | Lee | |
| 2010/0214769 | A1 | 8/2010 | Bhargava et al. | |
| 2010/0238655 | A1 * | 9/2010 | Sloan et al. | 362/225 |
| 2010/0302777 | A1 * | 12/2010 | Knoll et al. | 362/235 |
| 2011/0019410 | A1 | 1/2011 | Ibanez et al. | |
| 2011/0141722 | A1 | 6/2011 | Acampora et al. | |
| 2012/0002411 | A1 * | 1/2012 | Ladewig | 362/225 |
| 2012/0120651 | A1 | 5/2012 | Peck | |

FOREIGN PATENT DOCUMENTS

| | | | |
|---|---|---|---|
| JP | 2009/230856 | A | 10/2009 |
| WO | WO2008/134424 | A2 | 11/2008 |

OTHER PUBLICATIONS

International Search Report and Written Opinion for PCT/US12/45394, Oct. 19, 2012, -copy consists of 11 unnumbered pages.
EP Summons to attend oral proceedings received in corresponding EP Application No. 12807694.0, dated Feb. 3, 2015, pp. 1-30.

* cited by examiner

LED LUMINAIRE UTILIZING AN EXTENDED AND NON-METALLIC ENCLOSURE

RELATED APPLICATIONS

This application is a continuation-in-part of co-pending U.S. patent application Ser. No. 12/947,239, filed on Nov. 16, 2010, entitled LED LUMINAIRE UTILIZING AN EXTENDED AND NON-METALLIC ENCLOSURE, which is hereby incorporated by reference in its entirety.

BACKGROUND

A luminaire is a light unit used to artificially illuminate surfaces and objects with white light so that the reflected light may be reasonably seen by humans. A luminaire provides sufficient illuminance levels on walls, objects, and working surfaces adequate for human navigation and interaction. Previous luminaire enclosures were made using thermally conductive metals, such as aluminum, in order to dissipate heat effectively. The metal enclosures efficiently conducted heat away from the light source; however, the metal adds significant weight and cost to the luminaire.

In addition, some applications require luminaires that have restrictions on the type of materials that may be used for the enclosure. For example, the presence of metal enclosures may be prohibited in some applications.

SUMMARY

In one embodiment, the present disclosure teaches a light emitting diode (LED) luminaire. In one embodiment, the LED luminaire comprises a linearly extended enclosure having an interior volume, one or more sides and a light exiting portion along a length of the linearly extended enclosure, wherein the one or more sides each comprise an inside surface and an outside surface, wherein at least a portion of the linearly extended enclosure comprises an extruded optically clear plastic, one or more first LEDs mounted on the inside surface of the one or more sides of the linearly extended enclosure and a reflector coupled to the interior volume of the linearly extended enclosure, wherein the reflector redirects light from the one or more first LEDs.

In another embodiment, the present disclosure teaches an LED luminaire for producing at least 1000 lumens of visible light. The LED luminaire comprises a linearly extended enclosure having an interior volume, one or more sides and a light exiting portion along a length of the linearly extended enclosure, wherein the one or more sides each comprise an inside surface and an outside surface, wherein at least a portion of the linearly extended enclosure comprises an extruded optically clear plastic, one or more first LEDs mounted on the inside surface of the one or more sides of the linearly extended enclosure and a reflector coupled to the interior volume of the linearly extended enclosure, wherein the reflector redirects light from the one or more first LEDs In another embodiment, the present disclosure teaches a method for producing an LED luminaire. In one embodiment, the method comprises extruding a non-metallic material to form a linearly extended enclosure, wherein at least a portion of the non-metallic material is optically clear, wherein a cross-section of the linearly extended enclosure does not change during the extruding, wherein the enclosure has an interior volume, one or more sides along a length of the linearly extended enclosure, wherein one or more sides each comprise an inside surface and an outside surface, cutting the linearly extended enclosure after the extruding to a length of at least twelve inches to form a first open end and a second open end, coupling one or more LEDs coupled to the inside surface of the one or more sides of the linearly extended enclosure, coupling a reflector to the interior volume of the linearly extended enclosure and sealing the first open end with a first end cap and the second open end with a second end cap.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

Embodiments of the present disclosure are directed towards a light emitting diode (LED) based luminaire utilizing a non-metallic enclosure. Herein, a luminaire is a light unit that emits visible light of at least 1000 lumens. Luminaires may be used for various types of applications. However, for some applications, at least 1000 lumens of visible light are needed. For example, humans need at least 0.1 foot-candles to navigate in outdoor areas and at least 10 foot-candles in order to function effectively in office areas. It should be noted that toys, computers, calculators, electronics, entertainment units, handheld flashlights, gadgets, or other small electronic units that use LED based indicator lights do not emit at least 1000 lumens of visible light and are, therefore, not considered luminaires.

Currently, luminaires are made using metal enclosures. Aluminum enclosures may provide good thermal conductivity; however, this makes the luminaire very heavy and expensive. The metal enclosure is typically sand cast or die cast. However, some applications prohibit the use of metal for the enclosure for luminaires.

A plastic enclosure can provide a lighter and lower cost option for the enclosure; however the geometry of the enclosure needs to be significantly different than traditional LED-based enclosure geometries in order to effectively dissipate heat away from the LEDs and keep the LEDs at low operating temperatures. Non-metallic enclosures may also be required in such applications as nuclear reactors or for corrosion resistant applications. In addition to the unique geometry, various materials may be used within the enclosure in order to transfer heat efficiently away from the individual LEDs. As a result, a lighter and lower cost LED-based light luminaire can be made.

In addition, previous luminaires were designed to include a set of components including a light source, a circuit board, a metal enclosure, and a lens cover. In contrast, the new LED-based light luminaire may be designed to include a set of components including one or more LEDs, an LED circuit board, a heat transfer material, a light-transmitting plastic extrusion, and two or more sealing caps.

Figure 1:
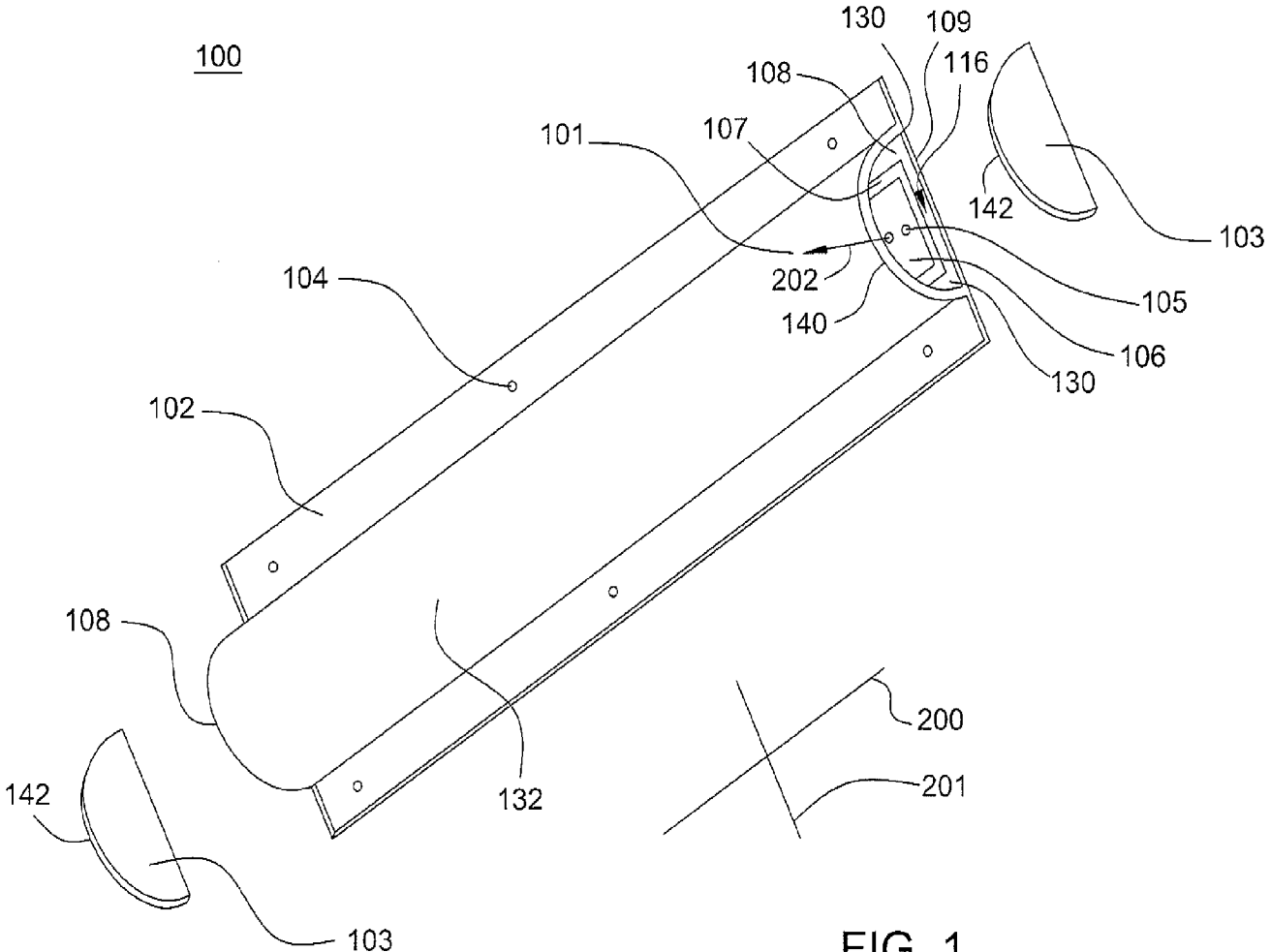
FIG. 1 depicts an isometric view of one embodiment of an LED-based luminaire.

FIG. 1 illustrates an isometric view of one embodiment of the LED-based luminaire 100 of the present disclosure. The luminaire 100 includes an extruded enclosure 101. The enclosure 101 comprises a flat side 109 and one or more open ends 108. The enclosure 101 has an interior volume which encloses one or more LEDs 105 and one or more LED circuit boards 106. The one or more LEDs 105 are coupled to the one or more LED circuit boards 106.

In one embodiment, the one or more LEDs 105 may be alternating current (AC) LEDs so that a power supply is not needed. The one or more LEDs 105 may be arranged in a series-parallel fashion and powered directly from a high voltage AC input power. As an example, the one or more LEDs 105 may be configured in two long strings. In one embodiment, there is a first string of LEDs 105 and a second string of LEDs 105. The LEDs 105 are arranged in one electrical direction for the first string and in the opposite electrical direction for the second string. When the AC input voltage is positive, the current flows through the first string. When the AC input voltage is negative, the current flows through the second string. Other electrical components may be used in addition to the first string and second string. This arrangement will be referred to as an AC LED configuration herein. In one embodiment, the LED-based luminaire 100 utilizes an AC LED configuration. This simplifies the LED-based luminaire 100 by eliminating the need for an internal power supply.

Figure 3:
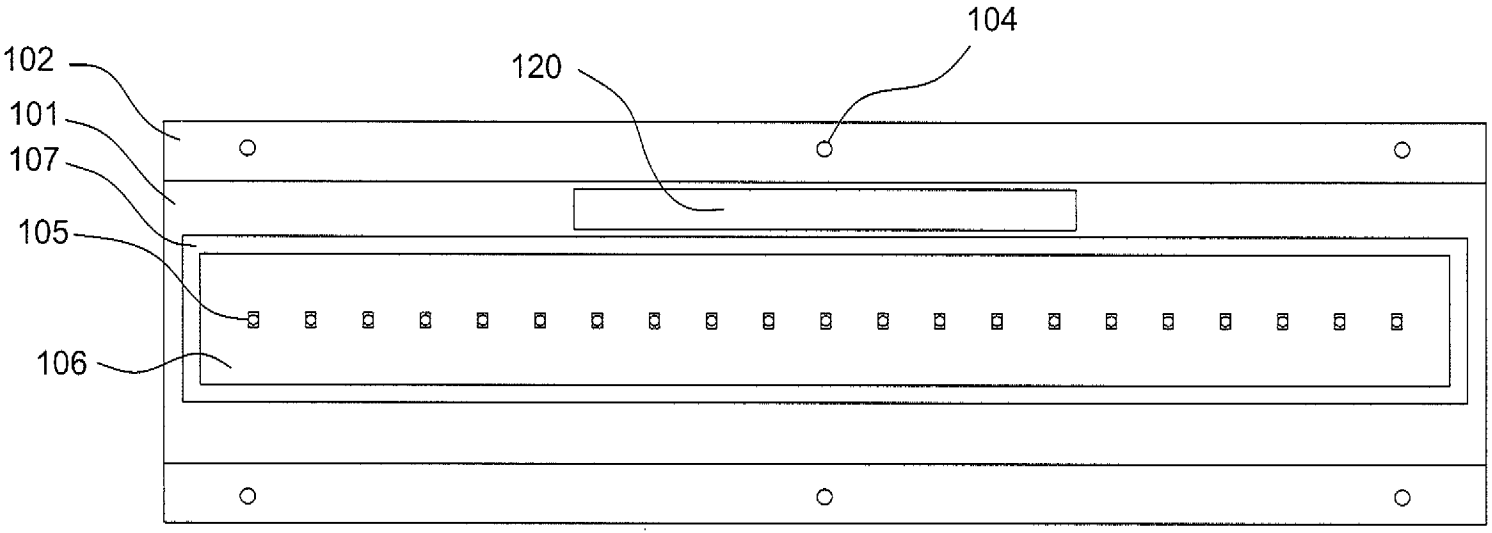
FIG. 3 depicts a top view of one embodiment of the LED-based luminaire with a power supply.
Figure 4:
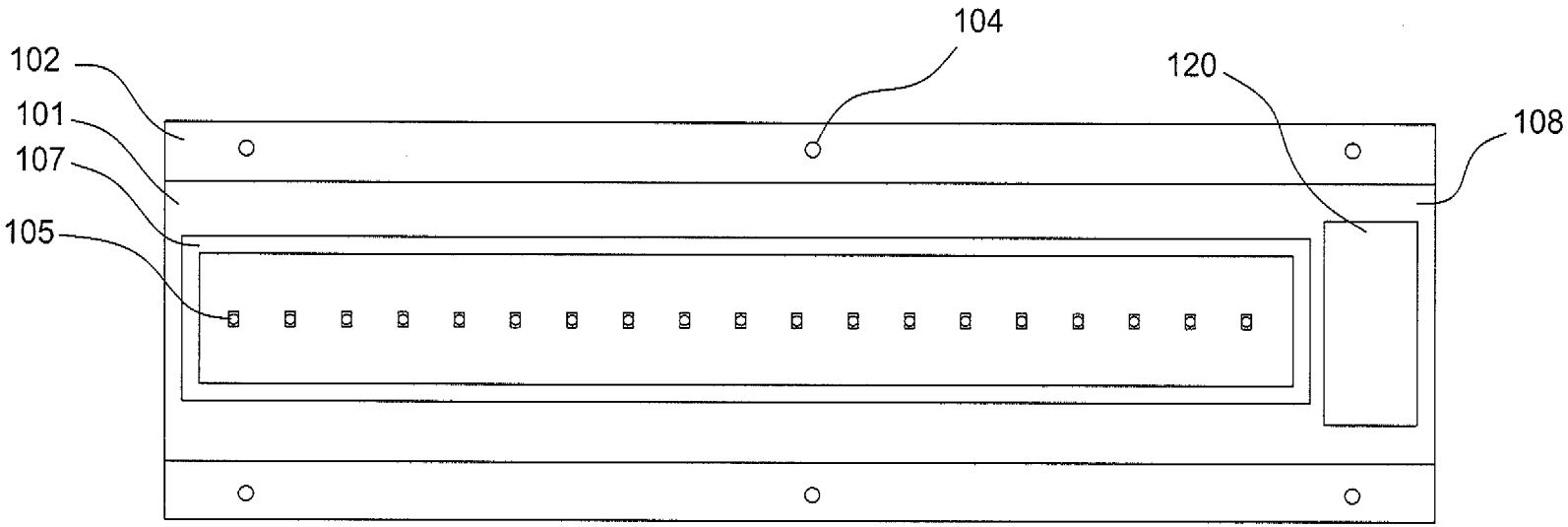
FIG. 4 depicts a top view of another embodiment of the LED-based luminaire with a power supply.

In another embodiment, a power supply 120 may be used to power the one or more LEDs 105, as illustrated by FIGS. 3 and 4. FIGS. 3 and 4 illustrate a top view of various configuration of a power supply 120 for the LED based luminaire 100 if the power supply 120 is needed. The power supply 120 may be used to drive the LEDs 105 at a set drive current or drive voltage. It should be noted that more than one power supply 120 may be used. The power supply may convert from AC to direct current (DC). The power supply 120 may convert DC input voltage to a constant current output to the one or more LEDs 105.

FIG. 3 shows a top view of an example LED-based luminaire 100 with the power supply 120 used to drive the one or more LEDs 105 located inside the enclosure 101. In one embodiment illustrated by FIG. 3, the power supply 120 may be located to the side of the one or more LED circuit boards 106 as shown in FIG. 3.

In another embodiment, the power supply 120 may be located towards the one or more ends 108 of the one or more LED circuit boards 106 as shown in FIG. 4. In one embodiment, the power supply 120 may be located remotely outside of the enclosure 101.

Figure 6:
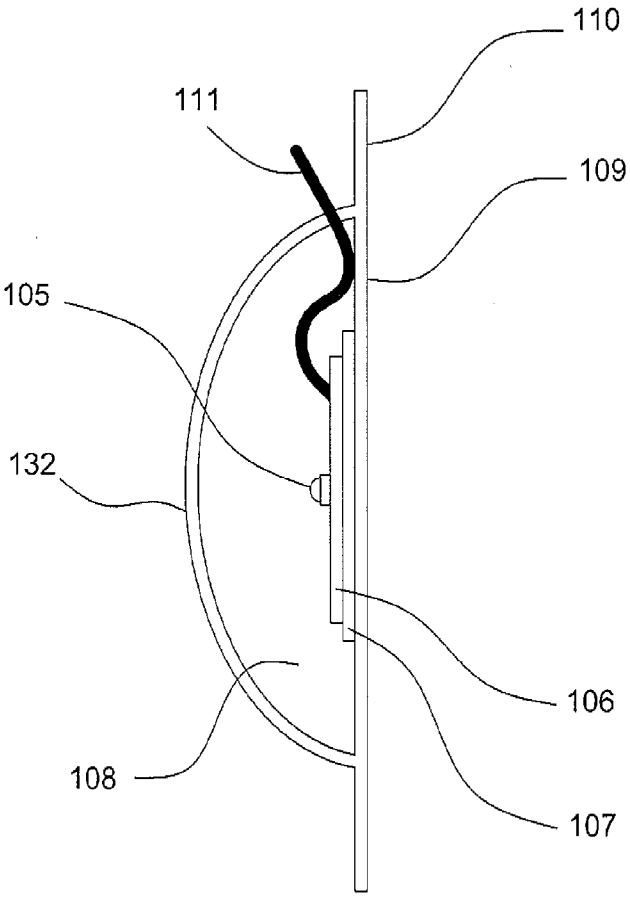
FIG. 6 depicts a side view of another embodiment of a wire path of the LED-based luminaire.
Figure 5:
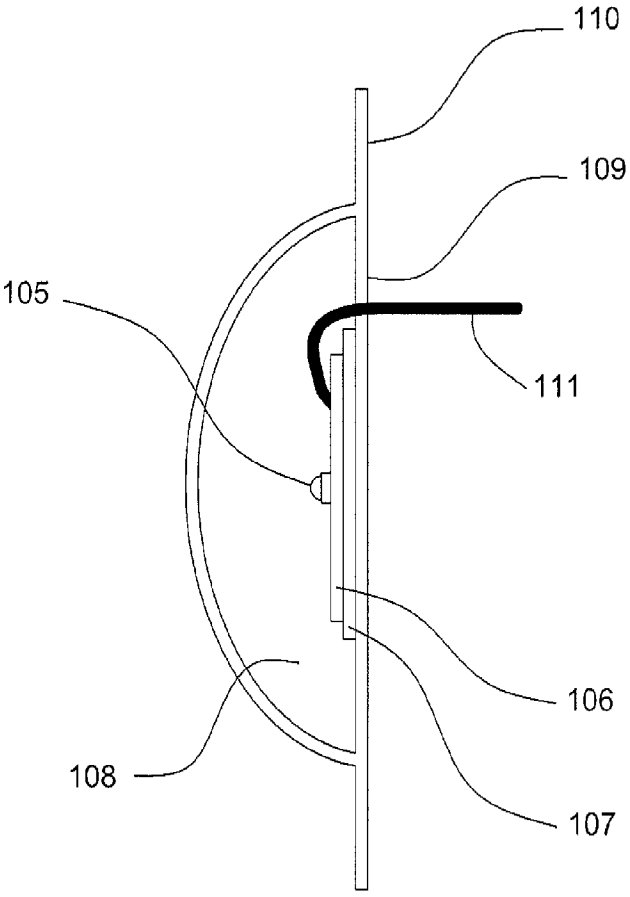
FIG. 5 depicts a side view of one embodiment of a wire path of the LED-based luminaire.

The electrical connection to the LED-based luminaire 100 may be made through a hole in one or more of the one or more end caps 103 or through a hole in the enclosure 101. FIGS. 5 and 6 illustrate cross sectional side views of various embodiments of how an electrical connection 111 is made. In one embodiment, the electrical connection 111 is made through the flat side 109 of the enclosure 101, as shown in FIG. 5. In other words, the electrical connection 111 is made through a side of the enclosure 101 that is opposite the direction of light emitted by the one or more LEDs 105.

In another embodiment, the electrical connection 111 is made through a curved portion 132 of the enclosure 101. In other words, the electrical connection 111 is made on the same side of the enclosure 101 as the direction of light emitted by the one or more LEDs 105 as shown in FIG. 6.

Referring back to FIG. 1, the one or more LEDs 105 emit light in a forward direction and in the direction of a curved portion 132 of the enclosure 101. The curved portion 132 of the enclosure 101 is optically clear so that light may be transmitted through the plastic. Other parts of the enclosure 101, such as the flat side 109, for example, may be colored or painted. This may eliminate glow of the light from internal reflections. This may also help to hide other internal components.

In one embodiment, the enclosure 101 may be extruded with two or more different types of plastic materials during the extrusion process. For example, the enclosure 101 may be extruded with a transparent plastic and a non-transparent plastic. The transparent plastic may be directed to the curved portion 132 while the nontransparent material may be directed to the flat side 109.

In one embodiment, some parts of the enclosure 101 may be textured. Providing texture helps to diffuse light emitted by the individual LEDs 105 to give the luminaire 100 a less "pixelated" look. The texture may also help to hide other internal components. The texture may be applied with any process such as sand blasting, chemical etch and the like. Although the surface of the enclosure 101 may have texture, the enclosure 101 may still maintain a substantially constant cross section along the length of the extrusion.

Figure 7:
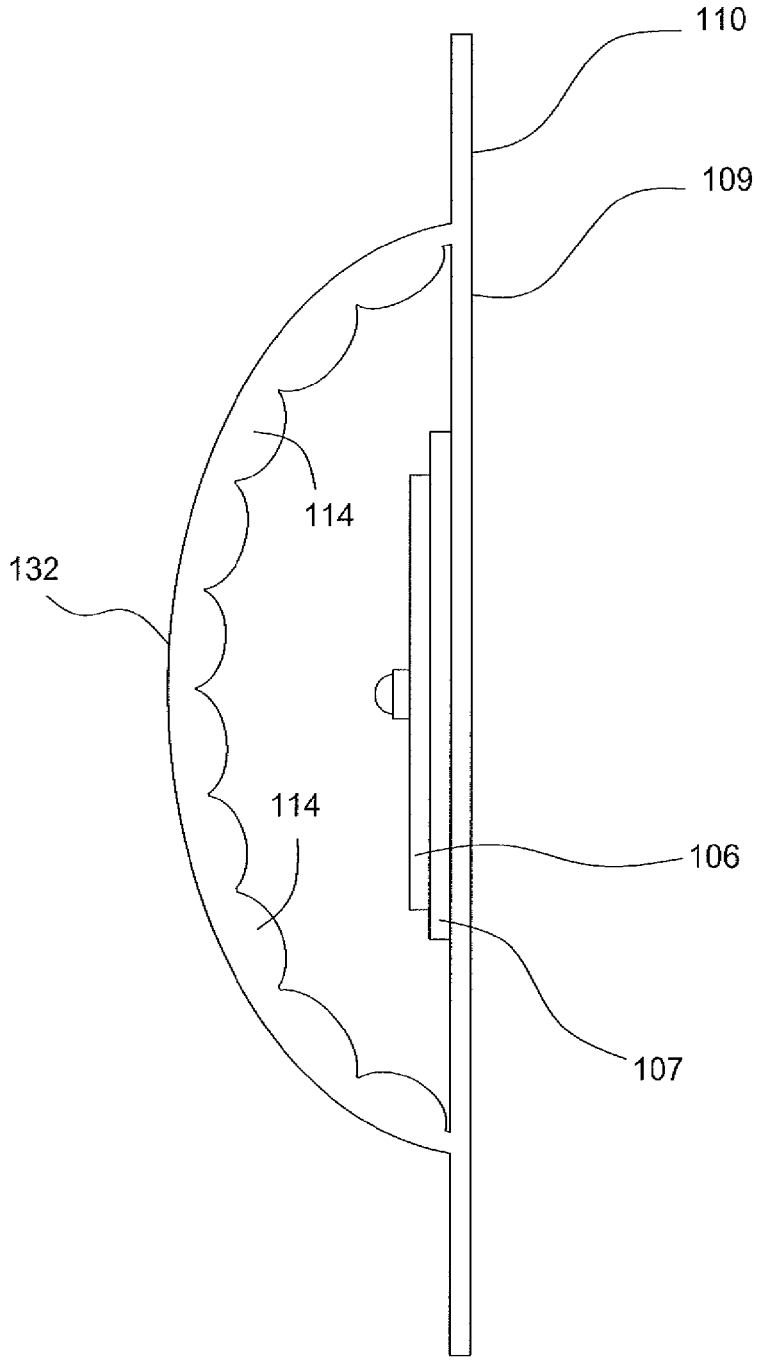
FIG. 7 depicts a side view of one embodiment of the LED-based luminaire with optical features.

In one embodiment, the enclosure 101 may also be extruded to have features such as ribs to help diffuse light. FIG. 7 illustrates a cross sectional side of one embodiment of the LED-based luminaire 100. FIG. 7 illustrates one or more ribs 114 on the curved portion 132 of the enclosure 101. It should be noted that the size of the ribs 114 are exaggerated for illustration purposes.

Referring back to FIG. 1, the one or more LED circuit boards 106 are coupled to an inside surface 116 of the flat side 109 via an interface material 107. In one embodiment the interface material 107 may be an adhesive such as a tape, a double sided adhesive tape or a glue.

In one embodiment, the one or more LED circuit boards 106 may be combined with the interface material 107 as a single assembly. For example, the one or more LED circuit boards 106 may be stamped into the interface material 107 and then overmolded as a single assembly. In another embodiment, the one or more LED circuit boards 106 may be a metal core circuit board.

In another embodiment, the interface material has a conductivity of at least 150 Watts per meter Kelvin (W/(m*K)) in an x and y direction and at least 1 W/(m*K) in a z direction. The x, y, z coordinate system may be a Cartesian coordinate system. One example material with such conductive properties is graphite. As a result, the interface material 107 may be a graphite material and may be used in conjunction with an adhesive. In another embodiment, the interface material 107 may be copper. Copper heat spreaders may be used both to provide the electrical path and conduct the heat away from the light source.

In order to ensure that the LEDs 105 have a long life, it is important that the heat is transferred away from the LEDs 105. Heat may be transferred more efficiently away from the LEDs 105 by using an interface material 107 with good thermal conductivity positioned between the LED circuit boards 106 and the flat side 109 of the enclosure 101. Graphite or carbon fiber can have very good thermal conductivity and can be produced in sheet form as the interface material 107. Furthermore, graphite can be an anisotropic media and therefore have superior thermal conductivity along an in-plane compared to a cross-plane. In one embodiment, the graphite is positioned so that the plane of higher thermal conductivity is aligned along the plane formed by the axis 200 and axis the 201. That is to say that the thermal conductivity is higher in the plane perpendicular to an LED optical axis 202.

In one embodiment, graphite is used as a filler for the plastic extrusion material. The graphite may have an adhesive backing on one or more sides so that it could be used to secure the one or more LED circuit boards 106 to the flat side 109 of the main enclosure 101.

Figure 8:
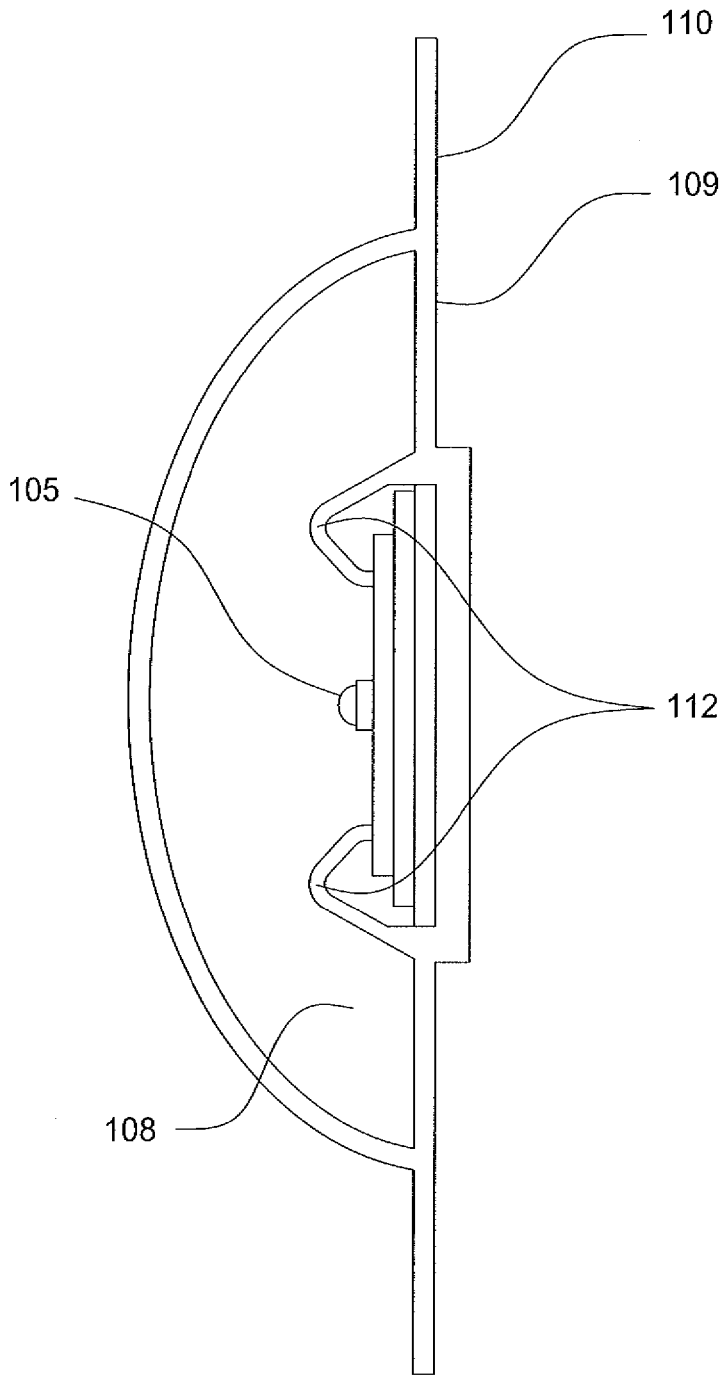
FIG. 8 depicts a side view of one embodiment of the LED-based luminaire with mechanical fasteners.

In another embodiment, the one or more LED circuit boards may be coupled to the flat side 109 using one or more mechanical fasteners 112 as illustrated in FIG. 8. In one embodiment, the mechanical fasteners 112 may be part of the extrusion and formed as an "arm." The mechanical fasteners 112 may extend around the sides of the one or more LED circuit boards 106 and apply a force to the one or more LED circuit boards 106. The mechanical fasteners 112 may be preloaded to apply pressure towards the flat side 109 of the enclosure 101: As a result, the mechanical fasteners 112 can hold the one or more LED circuit boards 106 to the flat side 109 of the enclosure 101 via a spring retention force.

In a further embodiment, the mechanical fasteners 112 may be separate parts from the extrusion. In a further embodiment, the mechanical fasteners 112 may be metal. This may improve the spring retention strength of the mechanical fasteners 112 over time. The metal mechanical fasteners 112 may be completely enclosed inside the enclosure 101.

In one embodiment, a combination of the mechanical fasteners 112 and the interface material 107 may be used. For example, a graphite sheet may be placed between the one or more LED circuit boards 106 and the flat side 109 of the enclosure 101 and the mechanical fasteners 112 may be used.

In another embodiment, the interface material 107, e.g., a heat spreader, is sized such that mechanical attachment to the wall of the enclosure 101 is not required. In other words, the interface material 107, e.g., a heat spreader, cools the LED 105 sufficiently that radiation and conduction heat transfer effectively cool the system without the interface material 107 being secured to the walls of the enclosure 101.

Referring back to FIG. 1, the extruded enclosure 101 may comprise any type of optically clear material that can be extruded such as polymers, plastics, glass, or ceramics. Any material may be used to extrude the enclosure as long as the material has a transmission to visible light of more than 70%.

The extruded enclosure 101 provides a very extended enclosure (i.e., along a length of the enclosure 101). In other words, the enclosure 101 is extended linearly and has a generally constant cross section along a length of the enclosure 101. Extrusion is a process used to create objects of a fixed cross-sectional profile. A material is pushed or drawn through a die of the desired cross-section. For example, FIG. 1 illustrates two axes, an axis 200 and an axis 201. The enclosure 101 is extruded by drawing the material through along a length of the of the enclosure 101 parallel to the axis 200. In other words, the axis 200 is the axis of extrusion of the enclosure 101. The features of the enclosure 101 do not change along the length of the enclosure that runs parallel to the axis 200.

The main advantages of this process over other manufacturing processes are its ability to create very complex cross-sections and work materials that are brittle, because the material only encounters compressive and shear stresses. It also forms finished parts with nice surface finishes. In addition, depending on the size of the object, extrusion can provide a cheaper process due to the high cost of creating a unique mold for large objects.

The extruded enclosure 101 is one important feature of the present disclosure. The extruded enclosure 101 provides many advantages over previous luminaires that used metallic housings. For example, when using metal enclosures for luminaires, heatsink fins are commonly used as an integral part of the enclosure. Metal fins efficiently conduct heat away from the light source.

Long integral plastic fins, as part of a plastic enclosure, are not highly effective at dissipating heat due to the lower thermal conductivity of plastics compared to metals. Heat is not transferred efficiently along a long fin length when using plastic. For example, polycarbonate has a thermal conductivity of 0.2 w/(m*K) compared to aluminum of about 200 w/(m*K). As a result, compact enclosure designs typical for luminaires, such as round or square geometries, would not be effective for an LED luminaire utilizing a non-metallic enclosure. An enclosure made using an extrusion makes for a very extended enclosure and helps spread the LEDs 105 away from each other and therefore reduce the heat density. This allows the LEDs 105 to run cooler and therefore last longer and maintain higher light levels, while avoiding the use of metallic enclosures. Short integral plastic fins, as part of a plastic enclosure may provide some minor improvement to the heat dissipation and would not add cost to an extrusion.

In order to operate typical high power LEDs at acceptable temperature limits, each watt of LED power typically requires at least 1 square inch of surface area as a general rule. Heatsink fins are not very effective with a plastic enclosure and, therefore, the plastic enclosure may be extended to ensure that there is at least 1 inch between each watt of LED power. In one embodiment, the extruded enclosure 101 should be extended at least 12 inches (in) in length in order to provide sufficient heat transfer and, therefore, adequate LED density and light, while sufficiently dissipating the heat generated by the LEDs 105 to avoid the heat from having an adverse effect on the LEDs 105 or the enclosure 101. In one embodiment, the enclosure 101 is about 24, 48 or 96 inches in length.

In addition, the thickness of the enclosure 101 may be a function of area, conductivity of the material used to fabricate the enclosure 101 and the required amount of power dissipation. For example, if the enclosure 101 is too thin, the enclosure 101 will be too flimsy to hold all the necessary components and the enclosure 101 would not be structurally sound. If the enclosure 101 is too thick, the enclosure 101 will have too high of a thermal resistance (e.g., the conductivity will be too low) and/or the overall surface area of the enclosure 101 must be increased, thereby, increasing the overall size of the enclosure 101. As a result, the dimensions of the enclosure 101 may be determined by how much heat needs to be dissipated over a given length and how thick the enclosure 101 needs to be based upon an area, conductivity and power dissipation.

Another advantage of using an extruded enclosure 101 is that it is a 1-piece enclosure and, therefore, provides a better sealing mechanism than a 2-piece enclosure. For example, the one or more open ends 108 are formed by a continuous surface when the enclosure is created via an extrusion process. In one embodiment, continuous is defined as being absent of any breaks along a perimeter or outer edge. For example, the continuous surface is formed such that the enclosure cannot be opened along a length of the enclosure.

Notably, the corners 130 of the enclosure 101 do not have any gaps or openings created by mating two pieces together. That is, in previous luminaire designs that use a metallic enclosure, a lens would typically be coupled to the metallic enclosure. As a result, when sealing the ends an imperfect seal would be created due to the fact that it would be difficult to seal the corners where three different surfaces (e.g., a metallic enclosure, lens and end cap) would meet.

However, the design of the present enclosure only requires the seal to be formed between two surfaces, i.e., one or more end caps 103 and the one or more ends 108 of the enclosure 101. For example, the one or more end caps 103 have a continuous surface along the perimeter or outer edge 142. Notably, there are no breaks along the perimeter 142. The one or more ends 108 of the enclosure 101 also have a continuous surface along the perimeter or outer edge 140. Notably, there are no breaks along the perimeter 140. As a result, only two surfaces need to be sealed.

The end caps 103 may be machined or they may be molded. The end caps 103 may be sealed to the one or more ends 108 of the enclosure 101 with a gasket, an o-ring, or with glue. The end caps 103 may also be attached to the enclosure 101 by ultrasonic welding or by press-fitting. Notably, no gaps or openings are present in the corners 130 of the enclosure 101, thereby creating a better seal.

Alternatively, the enclosure 101 may comprise two or more extrusions that are solvent welded together. For example, all of the necessary components may be coupled to the two or more extrusions and the extrusions may be coupled together in a "clamshell" fashion and solvent welded to seal the extrusion.

Referring back to FIG. 1, the enclosure 101 may also include one or more flange sections 102. The one or more flange sections 102 may include one or more holes 104. In one embodiment, the enclosure 101 and the one or more flange sections 102 may be a single unit. In other words, the enclosure 101 may be extruded to have the one or more flange sections 102. In another embodiment, the one or more flange sections 102 may be coupled to the extruded enclosure 101. The one or more flange sections 102 may also be colored or painted.

The one or more flange sections 102 serve a key purpose in that it provides material for features such as the one or more holes 104. The one or more holes 104 may be used for mounting without creating a leak path into the enclosure 101. The one or more holes 104 may be drilled, stamped or punched after the extrusion process. The fixture may also be hung using the holes.

Figure 2:
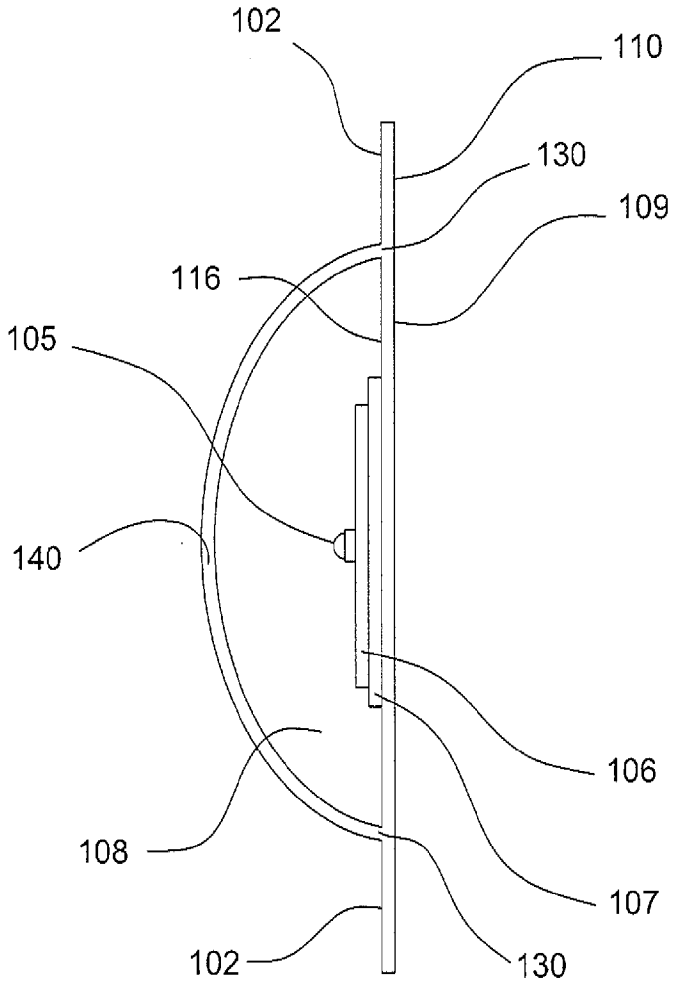
FIG. 2 depicts a side view of one embodiment of the LED-based luminaire.

FIG. 2 illustrates a cross sectional side view of one embodiment of the LED-based luminaire 100. As seen in FIG. 2, the enclosure 101 has a flat side 109 comprising an inside surface 116 and an outside surface 110. The outside surface 110 is exposed to outside air. The flat side 109 is substantially flat. In other words, bumps, curves, angles and the like should be minimized in the flat side 109.

The flat side 109 allows for mounting to a flat surface such as a wall or ceiling in order to have consistent physical contact with the surface to help conduct heat away. In one embodiment, the one or more flange sections 102 are on a same plane as the flat side 109. In other words, the flat side 109 and the one or more flange sections 102 are in alignment as illustrated by FIG. 2. This maintains the "flatness" of the flat side 109 for mounting as discussed above.

In summary, the LED-based luminaire 100 provides a lower cost and more efficient luminaire that can be used in a wider variety of applications than currently used luminaires. The extended geometry of the extruded enclosure 101 made from an optically clear material, such as an optically clear plastic for example, leads to many advantages. The novel design of the present LED-based luminaire 100 provides sufficient lighting (e.g., at least 1000 lumens of visible light) and heat management of heat generated by the LEDs using a non-metallic enclosure. This allows the LED-based luminaire 100 to be used in applications such as a nuclear power plant, which typically prohibits the use of metal enclosures due to corrosion concerns.

Figure 9:
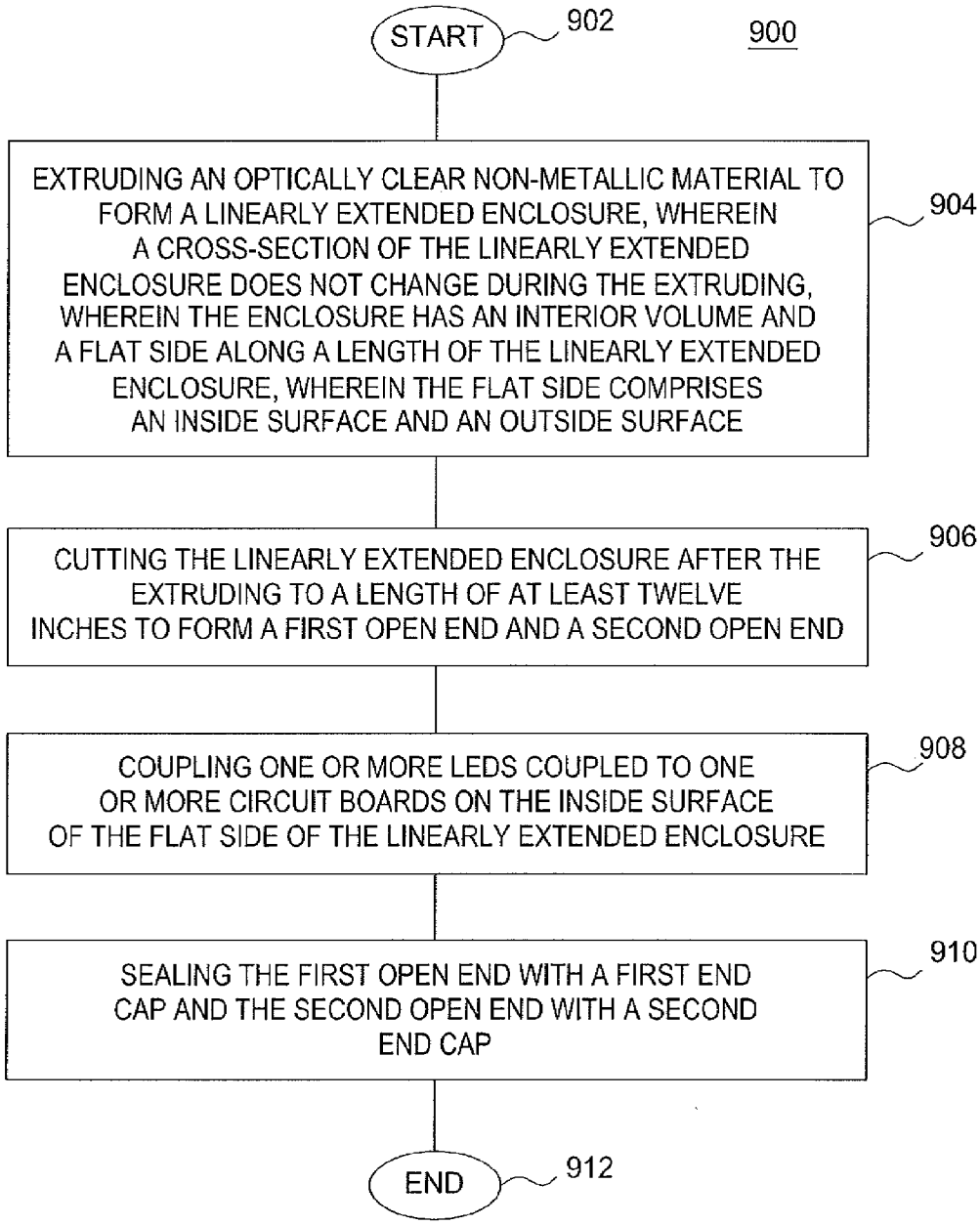
FIG. 9 depicts one embodiment of a flow chart of a method for producing the LED-based luminaire.

FIG. 9 illustrates one embodiment of a method 900 for producing the LED-based luminaire. In one embodiment, the method 900 may be performed by an automated machine under the control of a general purpose computer having a processor and memory. For example, one or more design parameters of the enclosure 101 may be stored in memory and the processor may execute a computer program that runs the automated machine to create an enclosure in accordance with the design parameters. The method 900 begins at step 902.

At step 904, the method 900 extrudes an optically clear non-metallic material to form an enclosure, wherein a cross-section of the enclosure does not change during the extruding, wherein the enclosure has an interior volume and a flat side along a length of the enclosure, wherein the flat side comprises an inside surface and an outside surface. As discussed above, the material may be any optically clear non-metallic material suitable for the extrusion process such as, for example, a polymer, a plastic, a glass, a ceramic and the like.

A cross section of the enclosure, may be considered to be along the axis 201 as illustrated in FIG. 1. The length of the enclosure may be considered to be along the axis 200 as illustrated in FIG. 1.

In one embodiment, the extrusion step 904 may also create various features of the enclosure as discussed above. For example, the extrusion step 904 may be used to create the one or more flanges 102 illustrated in FIG. 1, the ribs 114 illustrated in FIG. 7, the mechanical fasteners 112 illustrated in FIG. 8 and the like.

At step 906, the method 900 cuts the enclosure after the extruding to a length of at least twelve inches to form a first open end and a second open end. As discussed above, the enclosure must be long enough to reduce the heat density generated by a number of LEDs required to provide at least 1000 lumens of visible light. Since the enclosure is non-metallic, rather than transferring all of the heat generated by the LEDs away via a metallic enclosure or metallic heat sink fins, the enclosure of the present disclosure is designed to reduce heat density by elongating a length, thereby, resulting in an enclosure. As a result, in one embodiment the enclosure should be at least 12 inches. In another embodiment, the enclosure may be 24 in, 48 in or 96 in.

Moreover, using the extrusion process helps to manufacture the LED-based luminaire 100 more efficiently. For example, the extrusion step 904 may occur continually and as the extrusion is coming out, an enclosure of the desired length may be cut as described by step 906. This is in contrast to using a mold that would be a batch process, which requires starting and stopping the process between batches. Furthermore, building a mold for a large extended enclosure would likely be prohibitively expensive and molding the large extended enclosures would likely create significant manufacturing challenges.

At step 908, the method 900 couples one or more LEDs coupled to one or more circuit boards on the inside surface of the flat side of the enclosure. As discussed above, the one or more circuit boards may be coupled via an interface and/or one or more mechanical fasteners.

At step 910, the method 900 seals the first open end with a first end cap and the second open end with a second end cap. As discussed above, a consistent and reliable seal can be formed between the enclosure and the end caps because only two surfaces need to be sealed, i.e., the continuous surface of one end of the extruded enclosure and the continuous surface edge of the end cap. Referring to FIG. 1, the enclosure 101 does not have any gaps or openings in the corners 130 unlike current luminaires that create gaps or openings by coupling a lens to a metallic enclosure and then placing an end cap. This requires a seal to be formed between three surfaces which is more difficult. The method ends at step 912.

Figure 10:
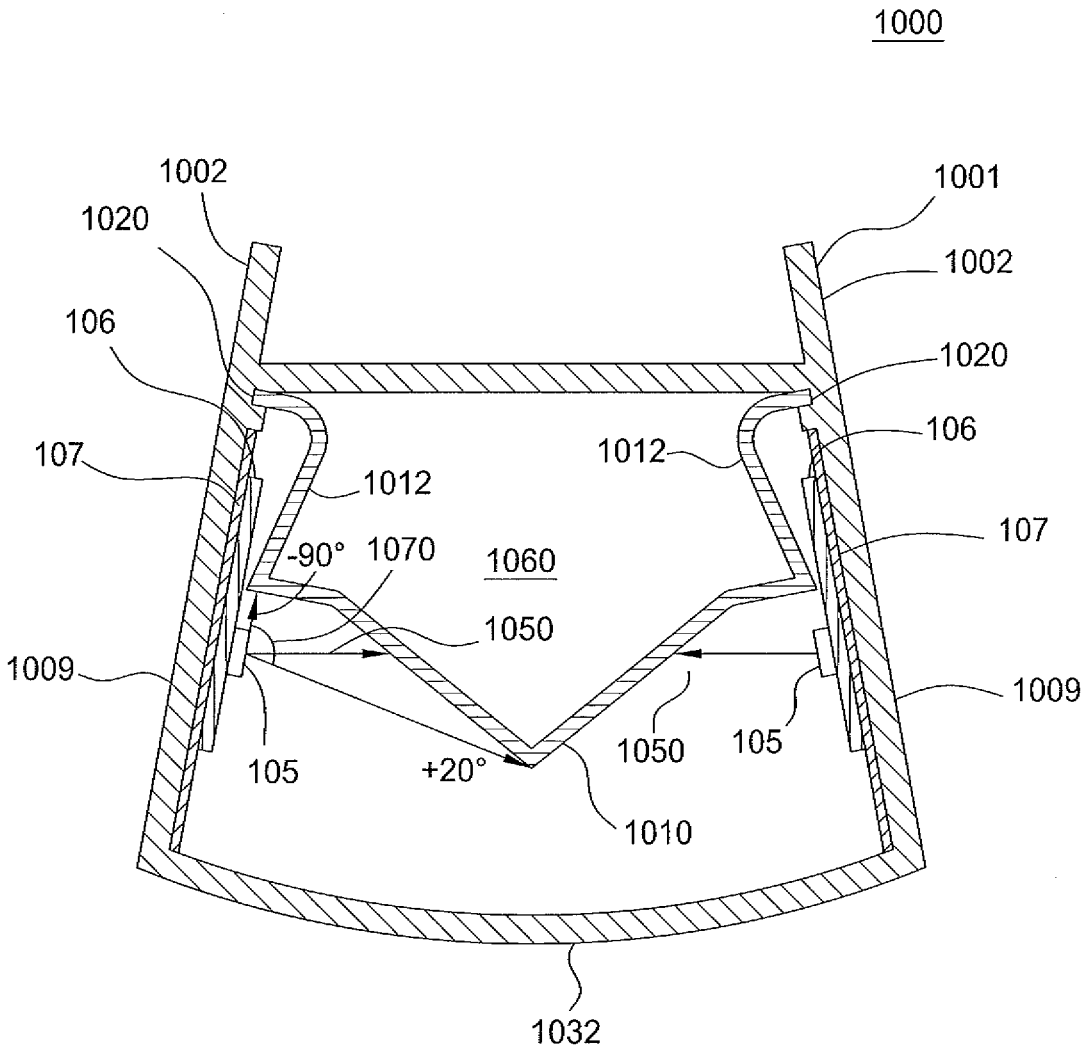
FIG. 10 depicts a front cross-sectional view of a second embodiment of a LED-based luminaire.

FIG. 10 illustrates a front cross sectional view of a second embodiment of an LED-based luminaire 1000. The LED-based luminaire 1000 includes an extruded enclosure 1001. The extruded enclosure 1001 includes sides 1009 and a light exiting portion 1032. In one embodiment, the sides 1009 may be flat. In one embodiment, the light exiting portion 1032 is curved. In one embodiment, the light exiting portion 1032 is concave with respect to the internal volume of the enclosure 1001. In a further embodiment, the light exiting portion 1032 may be substantially flat. FIG. 10 illustrates one or more LEDs 105 positioned on one side of the extruded enclosure 1001 and one or more LEDs 105 positioned on a second side of the extruded enclosure 1001.

In one embodiment, a first one of the one or more LEDs 105 are positioned on one side of the extruded enclosure 1001 and a second one of the one or more LEDs 105 are positioned on an opposing side of the extruded enclosure 1001. In one embodiment, a central light emitting axis 1050 of the first one of the one or more LEDs 105 is oriented at about 180° with respect to the central light emitting axis 1050 of the second one of the one or more LEDs 105 on the opposing side. In one embodiment, the 180° has a tolerance of +/−25°. In one embodiment, the central light emitting axis 1050 of both first one and the second one of the one or more LEDs 105 are directed inward. In one embodiment, the first one of the one or more LEDs 105 is positioned at about 90° with respect to the ground. In other words, the central light emitting axis 1050 of the first one of the one or more LEDs 105 is about 90° with respect to a vector that is normal to the ground and coming out of the ground.

Similar to the enclosure 101 illustrated in FIG. 1, the enclosure 1001 provides a very extended enclosure (i.e., along a length of the enclosure 1001). In other words, the enclosure 1001 is extended linearly and has a generally constant cross section along a length of the enclosure 1001. The features of the enclosure 1001 do not change along the length of the enclosure.

The extruded enclosure 1001 is one important feature of the present disclosure. The extruded enclosure 1001 provides many advantages of previous luminaires that used metallic housings. For example, when using metal enclosures for luminaires, heatsink fins are commonly used as an integral part of the enclosure. Metal fins efficiently conduct heat away from the light source.

An enclosure made using an extrusion makes for a very extended enclosure and helps spread the LEDs 105 away from each other and therefore reduce the heat density. This allows the LEDs 105 to run cooler and therefore last longer and maintain higher light levels, while avoiding the use of metallic enclosures. Short integral plastic fins, as part of a plastic enclosure may provide some minor improvement to the heat dissipation and would not add cost to an extrusion.

In order to operate typical high power LEDs at acceptable temperature limits, each watt of LED power typically requires at least 1 square inch of surface area as a general rule. Heatsink fins are not very effective with a plastic enclosure and, therefore, the plastic enclosure may be extended to ensure that there is at least 1 inch between each watt of LED power. In one embodiment, the extruded enclosure 1001 should be extended at least 12 inches (in) in length in order to provide sufficient heat transfer and, therefore, adequate LED density and light, while sufficiently dissipating the heat generated by the LEDs 105 to avoid the heat from having an adverse effect on the LEDs 105 or the enclosure 1001. In various embodiments, the enclosure 1001 is about 24, 48 or 96 inches in length.

In addition, the thickness of the enclosure 1001 may be a function of area, conductivity of the material used to fabricate the enclosure 1001 and the required amount of power dissipation. For example, if the enclosure 1001 is too thin, the enclosure 1001 may be too flimsy to hold all the necessary components and the enclosure 1001 would not be structurally sound. If the enclosure 1001 is too thick, the enclosure 1001 may have too high of a thermal resistance (e.g., the conductivity will be too low) and/or the overall surface area of the enclosure 1001 must be increased, thereby, increasing the overall size of the enclosure 1001. As a result, the dimensions of the enclosure 1001 may be determined by how much heat needs to be dissipated over a given length and how thick the enclosure 1001 needs to be based upon an area, conductivity and power dissipation.

The enclosure 1001 may include an optic that may redirect light emitted from the one or more LEDs 105. The optic may reflect or refract light emitted by the one or more LEDs 105. The optic may redirect light through total internal reflection (TIR), such as, when the light travels through a medium. For example, the medium may be plastic, glass or some other medium with a refractive index higher than that of air. The optic may reflect light via specular reflections or diffuse reflections. The enclosure 1001 may also include a reflector 1010 that is coupled to the inside of the enclosure 1001. In one embodiment, the reflector 1010 is coupled to the enclosure 1001 via one or more slots 1020. The reflector 1010 may be fabricated from any reflective material such as a metal (e.g., aluminum) or a metalized plastic. The reflector 1010 may be extruded or molded. In one embodiment, the reflector 1010 is integral with enclosure 1001. That is to say that the reflector 1010 and the enclosure 1001 may be a single extruded part. The reflector 1010 may be fabricated to include texture or optical features for diffusing or re-directing light emitted from the one or more LEDs 105. The cross section of the reflector 1010 may be symmetric.

The reflector 1010 may include "tabs" on each leg 1012 that are placed into the one or more slots 1020. The legs 1012 may be spring loaded to help keep the reflector 1010 in place and also to help keep the LED circuit boards 106 in place. However, it should be noted that the reflector 1010 may be coupled to the enclosure 1001 via other means such as an adhesive or mechanical means using a fastener or a screw. In one embodiment, the reflector 1010 may comprise smaller segments that slide into the one or more slots 1020 in multiple pieces, are glued via an adhesive to a portion of the enclosure 1001 or are mechanically fastened to the enclosure 1001.

When the reflector 1010 is coupled to the enclosure 1001, the reflector 1010 forms an interior volume 1060. The interior volume 1060 may provide a convenient area to place a power supply if an interior power supply is used.

In one embodiment, the enclosure may also include one or more LED circuit boards 106 having one or more LEDs 105. Unlike the LED-based luminaire 100 illustrated in FIG. 1 that emitted light from the one or more LEDs 105 directly downwards toward the curved portion 132, the LED-based luminaire 1000 may couple the LED circuit boards 106 to the sides 1009 such that the one or more LEDs 105 emit light in a direction perpendicular to the light exiting portion 1032 such that it is reflected off of the reflector 1010 and redirected towards the light exiting portion 1032. In other words, light is emitted from the one or more LEDs 105 in a direction of a central light emitting axis 1050 and is redirected by the reflector 1010. The central light emitting axis 1050 may be defined as the axis wherein the highest concentration of light is emitted.

In one embodiment, the reflector 1010 may be positioned such that a certain portion of the light emitted from the one or more LEDs 105 reflect off of the reflector 1010. For example, with respect to the central light emitting axis 1050 of the one or more LEDs 105, light emitted from a range of −90° to +20° with respect to the central light emitting axis 1050 of the one or more LEDs 105, as illustrated by range 1070, may be redirected by the reflector 1010. In one embodiment, the light emitted by the one or more LEDs 105 is redirected by the reflector 1010 so that the highest concentration of light emitted by the luminaire 1000 is at an angle of at least +25° with respect to the central light emitting axis 1050 of the one or more LEDs 105.

The redirected light may be emitted out of the light exiting portion 1032. In one embodiment, the light exiting portion 1032 may be molded or extruded with texture. Providing texture helps to diffuse light emitted by the individual LEDs 105 to give the luminaire 1000 a less "pixelated" look. The texture may also help to hide other internal components. The texture may be applied with any process such as sand blasting, chemical etch and the like. Although the surface of the enclosure 1001 may have texture, the enclosure 1001 may still maintain a substantially constant cross section along the length of the extrusion. In one embodiment, the enclosure 1001 may also be extruded to have features in the light exiting portion 1032 such as ribs to help diffuse light.

The one or more LED circuit boards may be coupled to the enclosure 1001 using an interface material 107. In one embodiment the interface material 107 may be an adhesive such as a tape, a double sided adhesive tape or a glue.

In one embodiment, the one or more LED circuit boards 106 may be combined with the interface material 107 as a single assembly. For example, the one or more LED circuit boards 106 may be stamped into the interface material 107 and then overmolded as a single assembly. This may be a heat spreader 1700 as illustrated by example in FIG. 17. In another embodiment, the one or more LED circuit boards 106 may be a metal core circuit board.

In another embodiment, the interface material has a conductivity of at least 150 Watts per meter Kelvin (W/(m*K)) in an x and y direction and at least 1 W/(m*K) in a z direction. One example material with such conductive properties is graphite. As a result, the interface material may be a graphite material used in conjunction with an adhesive.

In order to ensure that the LEDs 105 have a long life, it is important that the heat is transferred away from the LEDs 105. Heat may be transferred more efficiently away from the LEDs 105 by using an interface material 107 with good thermal conductivity positioned between the LED circuit boards 106 and the side 1009 of the enclosure 1001. Graphite or carbon fiber can have very good thermal conductivity and can be produced in sheet form as the interface material 107. Furthermore, graphite can be an anisotropic media and therefore have superior thermal conductivity along an in-plane compared to a cross-plane.

In one embodiment, if the circuit board 106 is stamped into the interface material 107, the interface material 107 may be a conductive metal. For example, the interface material may be copper.

In another embodiment, the one or more LED circuit boards 106 may be coupled to the enclosure 1001 using a fastening means such as a screw. For example, small holes may be drilled into the enclosure 1001 to allow the one or more LED circuit boards 106 to be screwed to the sides 1009 of the enclosure 1001. The small holes would not puncture through the sides 1009 of the enclosure 1001 to prevent a leak path.

In one embodiment, the enclosure 1001 may also include one or more flange sections 1002. The one or more flange sections 1002 may include one or more holes. In one embodiment, the enclosure 1001 and the one or more flange sections 1002 may be a single unit. In other words, the enclosure 1001 may be extruded to have the one or more flange sections 1002. In another embodiment, the one or more flange sections 1002 may be coupled to the extruded enclosure 1001. The one or more flange sections 1002 may also be colored or painted.

The one or more flange sections 1002 serve a key purpose in that it provides material for features such as the one or more holes. The one or more holes may be used for mounting without creating a leak path into the enclosure 1001. The one or more holes may be drilled, stamped or punched after the extrusion process. The fixture may also be hung using the holes.

Figure 11:
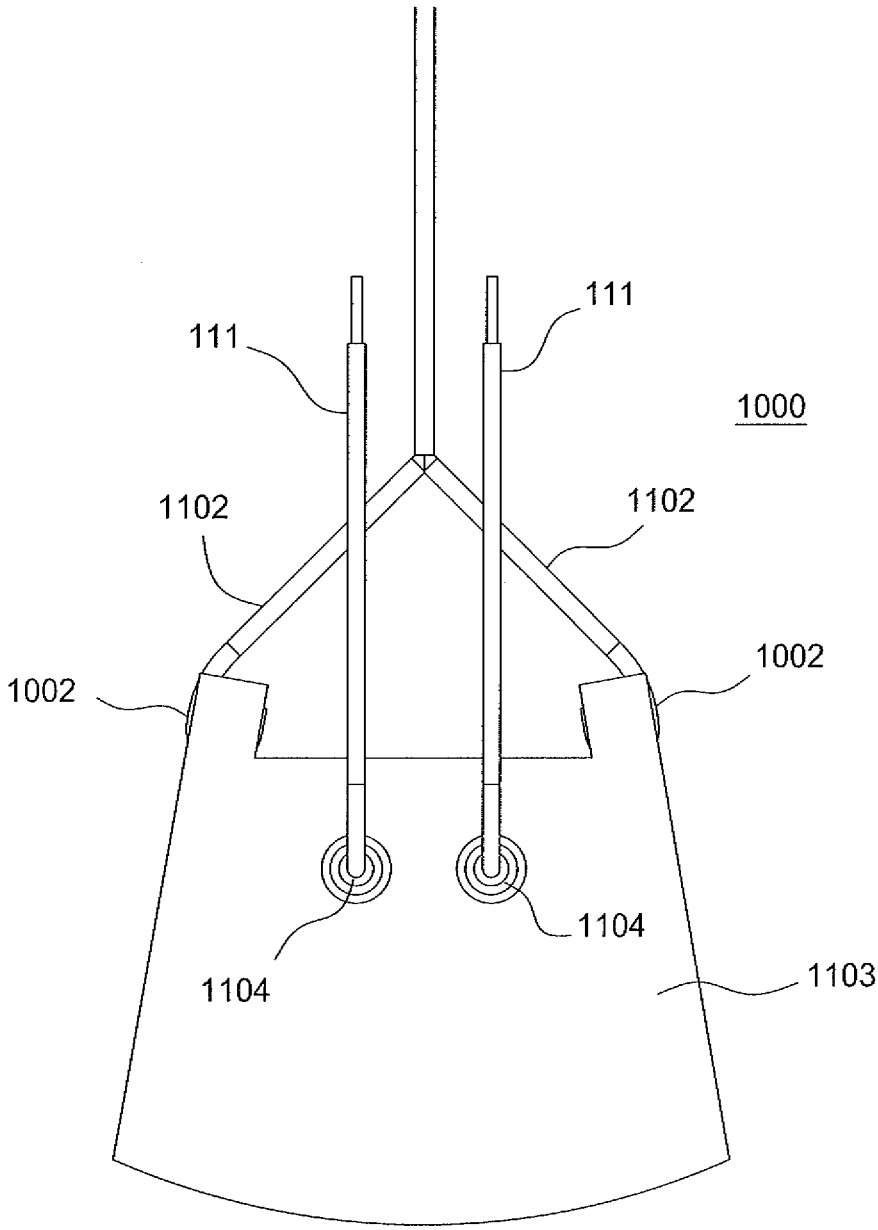
FIG. 11 depicts a front view of the second embodiment of the LED-based luminaire with an internal or remote power supply.

FIG. 11 illustrates a front view of the LED-based luminaire 1000 having an internal or remote power supply. One or more holes 1104 may be provided on an end cap 1103 to allow electrical connections 111 to be made to the power supply.

Figure 12:
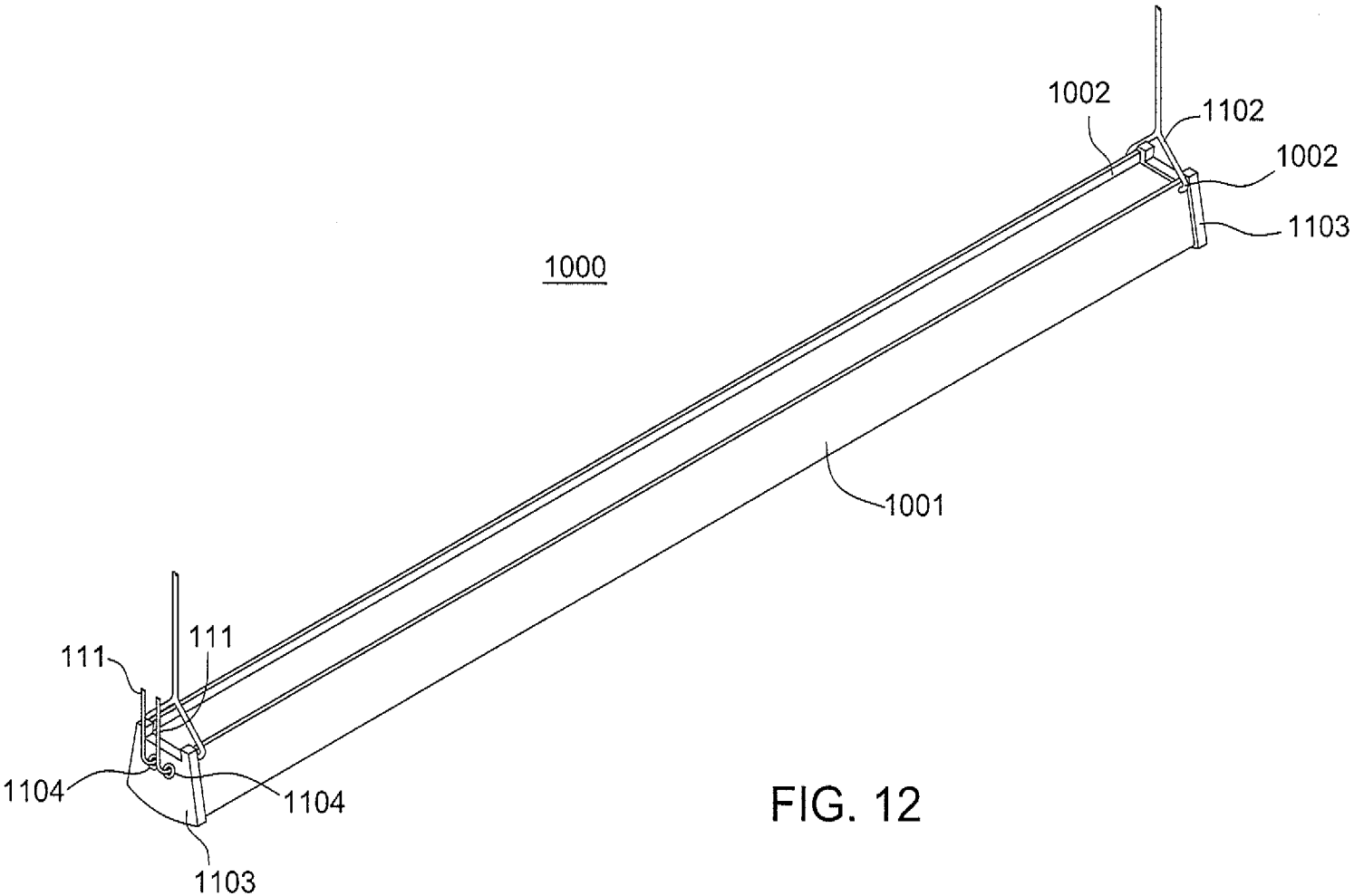
FIG. 12 depicts an isometric view of the second embodiment of the LED-based luminaire with an internal or remote power supply.

In addition, the one or more flange sections 1002 may be used to allow a hanging means 1102, e.g., a metal hook or fasteners, to be coupled to the enclosure 1001 for mounting or hanging. An isometric view of the LED-based luminaire 1000 having an internal or remote power supply is illustrated in FIG. 12.

Figure 13:
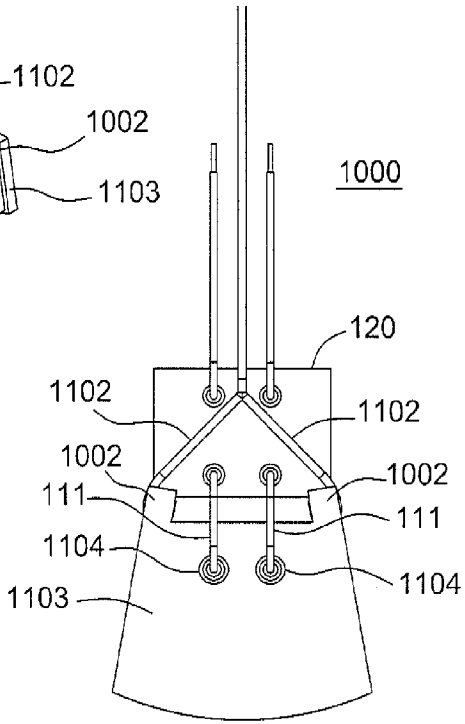
FIG. 13 depicts a front view of the second embodiment of the LED-based luminaire with an external power supply.

FIG. 13 illustrates a front view of the LED-based luminaire 1000 having an external power supply 120. One or more holes 1104 may be provided on an end cap 1103 to allow electrical connections 111 to be made to the power supply 120.

Figure 14:
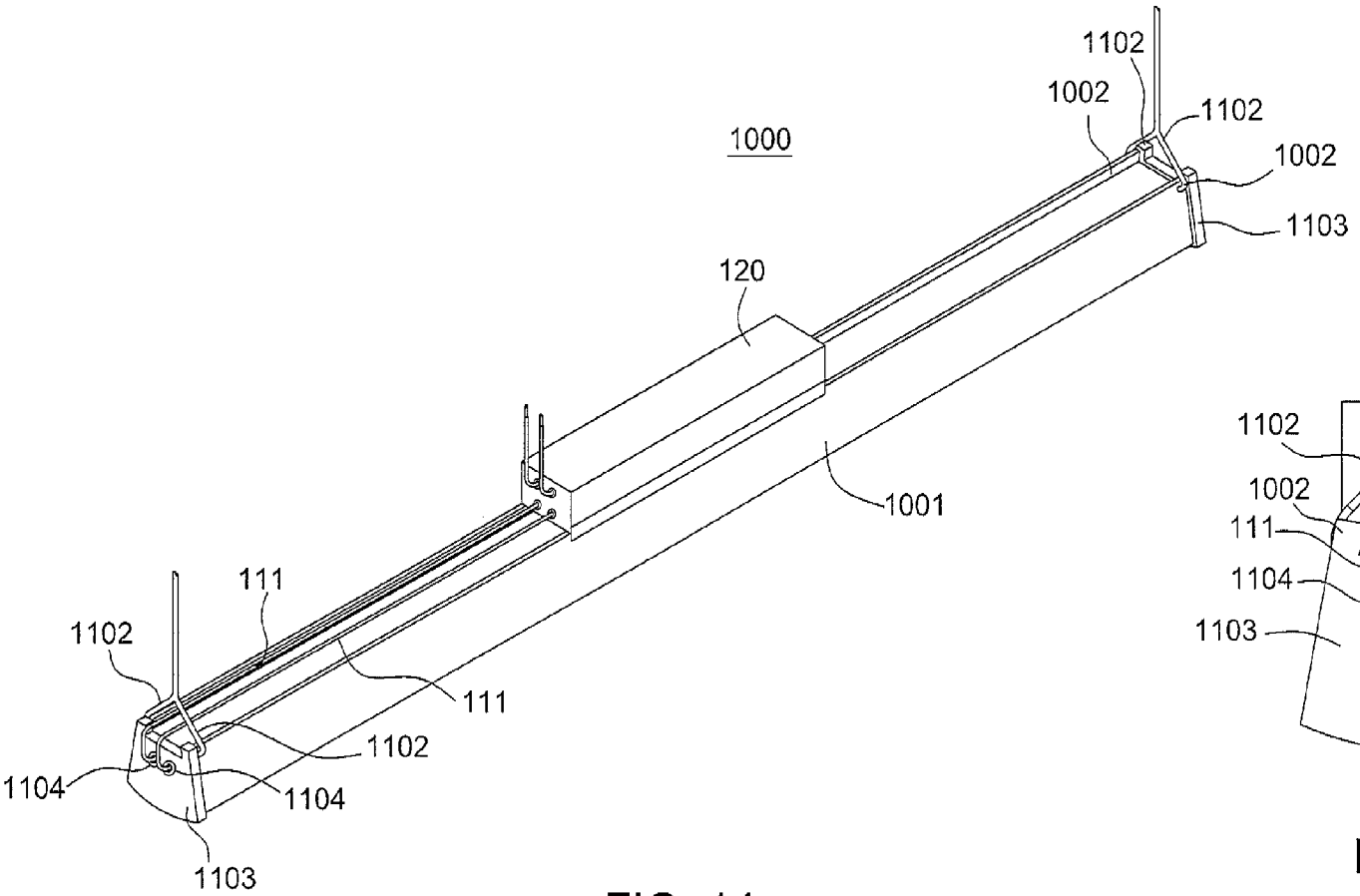
FIG. 14 depicts an isometric view of the second embodiment of the LED-based luminaire with an external power supply.

In addition, the one or more flange sections 1002 may be used to allow a hanging means 1102, e.g., a metal hook or fasteners, to be coupled to the enclosure 1001 for mounting or hanging. An isometric view of the LED-based luminaire 1000 having an external power supply 120 is illustrated in FIG. 14.

Figure 15:
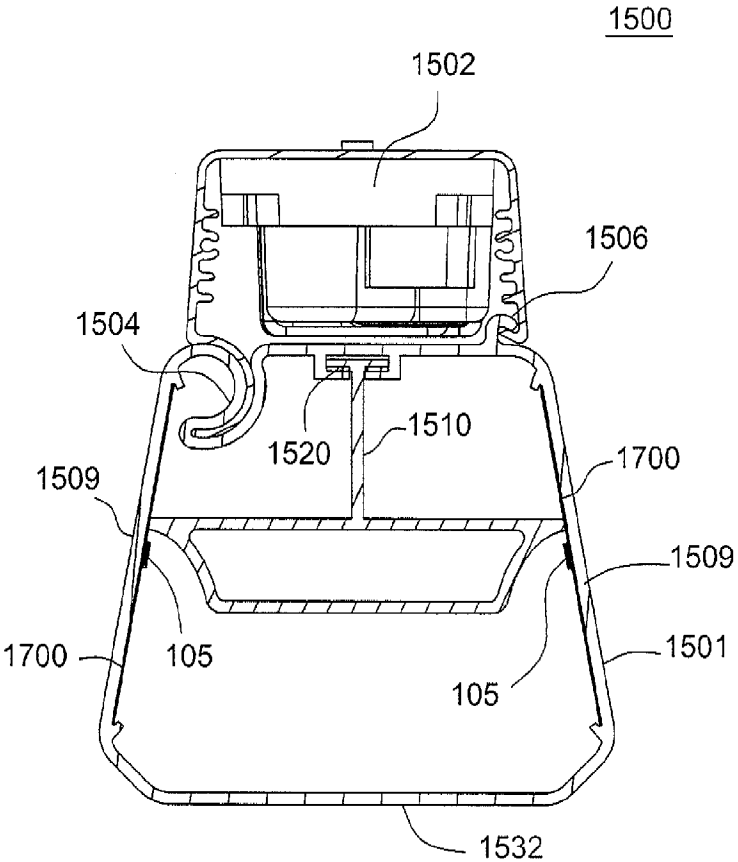
FIG. 15 depicts a front cross-sectional view of a third embodiment of a LED-based luminaire.

FIG. 15 illustrates a front cross-sectional view of a third embodiment of a LED-based luminaire 1500. The LED-based luminaire 1500 includes an extruded enclosure 1501. The extruded enclosure includes sides 1509 and a light exiting portion 1532.

In one embodiment, the one or more LEDs 105 may be positioned on the sides 1509 of the extruded enclosure 1501. In one embodiment, the one or more of the LEDs 105 may be positioned opposite one another on the opposing sides 1509 of the extruded enclosure 1501. In one embodiment, a heat spreader 1700 may be used to mount one or more of the LEDs 105 on at least one of the sides 1509. The heat spreader 1700 is illustrated in further detail in FIG. 17 and discussed below.

Similar to the enclosure 101 illustrated in FIG. 1, the enclosure 1501 provides a very extended enclosure (i.e., along a length of the enclosure 1501). In other words, the enclosure 1501 is extended linearly and has a generally constant cross section along a length of the enclosure 1501. The features of the enclosure 1501 do not change along the length of the enclosure.

The LED-based luminaire 1500 may also include a reflector 1510. The reflector 1510 may be coupled to the extruded enclosure 1501 via one or more mounting features 1520. For example, the mounting feature 1520 may be a slot, a clip, a ball and socket connection, or any other means for mounting the reflector to the extruded enclosure 1501.

In one embodiment, the LED-based luminaire 1500 may have an external power supply compartment 1502. The external power supply compartment 1502 may also be extruded and coupled to the extruded enclosure 1501 via a hinged mounting feature 1502 and a mechanical clip 1506. In one embodiment, the hinged mounting feature 1502 may be a "C" clamp or a hook and fastener type hinge.

Figure 16:
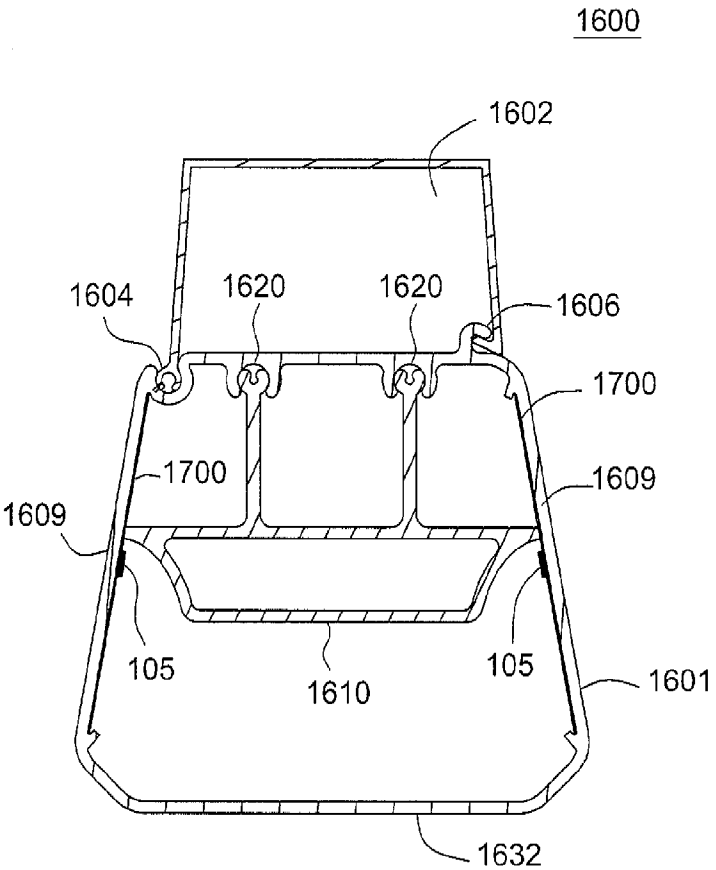
FIG. 16 depicts a front cross-sectional view of a fourth embodiment of a LED based luminaire.

FIG. 16 illustrates a front cross-sectional view of a fourth embodiment of a LED-based luminaire 1600. The LED-based luminaire 1600 includes an extruded enclosure 1601. The extruded enclosure includes sides 1609 and a light exiting portion 1632.

In one embodiment, the one or more LEDs 105 may be positioned on the sides 1609 of the extruded enclosure 1601. In one embodiment, the one or more of the LEDs 105 may be positioned opposite one another on the opposing sides 1609 of the extruded enclosure 1601. In one embodiment, a heat spreader 1700 may be used to mount one or more of the LEDs 105 on at least one of the sides 1609. The heat spreader 1700 is illustrated in further detail in FIG. 17 and discussed below.

Similar to the enclosure 101 illustrated in FIG. 1, the enclosure 1601 provides a very extended enclosure (i.e., along a length of the enclosure 1601). In other words, the enclosure 1601 is extended linearly and has a generally constant cross section along a length of the enclosure 1601. The features of the enclosure 1601 do not change along the length of the enclosure.

The LED-based luminaire 1600 may also include a reflector 1610. The reflector 1610 may be coupled to the extruded enclosure 1601 via one or more mounting features 1620. For example, the mounting feature 1620 may be a slot, a clip, a ball and socket connection, or any other means for mounting the reflector to the extruded enclosure 1601.

In one embodiment, the LED-based luminaire 1600 may have an external power supply compartment 1602. The external power supply compartment 1602 may also be extruded and coupled to the extruded enclosure 1601 via a hinged mounting feature 1602 and a mechanical clip 1606. In one embodiment, the hinged mounting feature 1602 may be a ball and socket type hinge.

Figure 17:
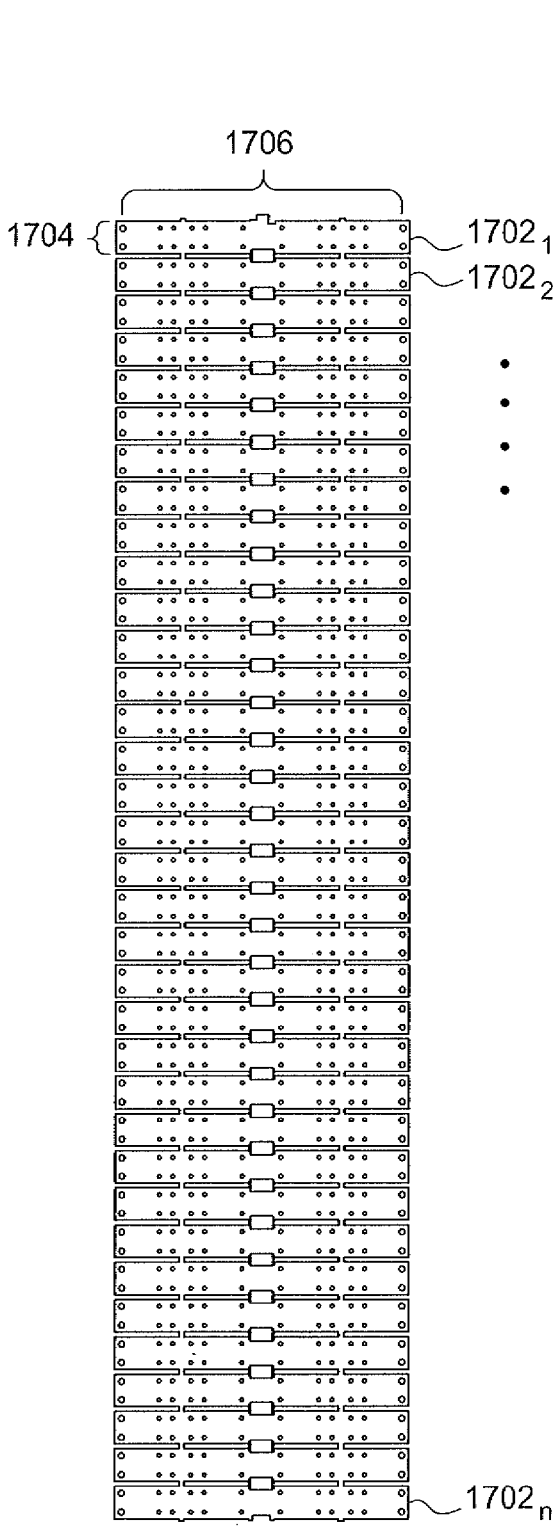
FIG. 17 depicts one embodiment of a heat spreader for facilitating natural convention.

FIG. 17 illustrates the heat spreader 1700 discussed above. The heat spreader 1700 may be fabricated from a conductive material, such as for example, a metal such as copper. The heat spreader 1700 may include many individual heat spreaders $\mathbf{1702}_1$ to $\mathbf{1702}_n$ (also referred to collectively as individual heat spreaders 1702) depending on the number of LEDs 105 that are required.

In one embodiment, a length 1706 of each one of the individual heat spreaders 1702 may be much greater than a width 1704. This allows heat to facilitate natural heat convection away from the LEDs 105. The ratio of the length 1706 to the width 1704 is a direct function of the amount of heat that needs to be dissipated away from the LEDs 105. In one embodiment, the ratio of the length 1706 to the width 1704 is approximately in a range of 9 to 10 to dissipate ⅓ of a Watt of heat.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light emitting diode (LED) luminaire, comprising:

a linearly extended non-metallic enclosure having an interior volume formed by a single extruded piece having one or more sides and a light exiting portion along a length of the linearly extended non-metallic enclosure, wherein the one or more sides each comprises an inside surface and an outside surface, wherein at least a portion of the linearly extended non-metallic enclosure comprises an optically clear plastic;

one or more first LEDs mounted directly on the inside surface of one of the one or more sides of the linearly extended non-metallic enclosure via an interface material; and a reflector coupled to the interior volume of the linearly extended non-metallic enclosure, wherein the reflector redirects light from the one or more first LEDs, wherein the reflector is located between the one or more first LEDs and one or more second LEDs that are positioned on an opposing side of the linearly extended non-metallic enclosure relative to the one or more first LEDs, wherein the one or more sides of the linearly extended non-metallic enclosure enclose the one or more first LEDs, the reflector and the one or more second LEDs.

2. The LED luminaire of claim 1, wherein a central light emitting axis of the one or more first LEDs is oriented at about 180° with respect to a central light emitting axis of the one or more second LEDs, wherein the 180° has a tolerance of +/−25°.

3. The LED luminaire of claim 1, wherein the one or more first LEDs are positioned such that a central light emitting axis of the one or more first LEDs is at about 90° with respect to a vector that is normal to a ground and coming out of the ground.

4. The LED luminaire of claim 1, wherein the linearly extended non-metallic enclosure comprises one or more slots, wherein the reflector comprises one or more legs having a tab, wherein the reflector is coupled to the linearly extended non-metallic enclosure by placing the tab into a respective one of the one or more slots.

5. The LED luminaire of claim 4, wherein the one or more legs of the reflector are spring loaded.

6. The LED luminaire of claim 4, wherein light emitted from the one or more first LEDs at an angle of −90° to +20° relative to a central light emitting axis of the one or more first LEDs is reflected off of the reflector.

7. The LED luminaire of claim 1, wherein the linearly extended non-metallic enclosure comprises one or more flange sections.

8. The LED luminaire of claim 7, wherein each one of the one or more flange sections includes one or more holes for mounting.

9. The LED luminaire of claim 1, wherein a seal is formed between a continuous surface along a perimeter of the linearly extended non-metallic enclosure and a continuous surface along a perimeter of an end cap on each end of the linearly extended non-metallic enclosure.

10. The LED luminaire of claim 1, wherein the interface material is disposed between the one or more first LEDs and the inside surface of the one or more sides of the linearly extended non-metallic enclosure.

11. The LED luminaire of claim 1, further comprising:

a power supply coupled to an interior volume of the reflector to provide power to the one or more first LEDs.

12. The LED luminaire of claim 1, further comprising:

a power supply coupled to an exterior side of the linearly extended non-metallic enclosure.

13. The LED luminaire of claim 1, wherein the LED luminaire provides at least 1000 lumens of visible light.

14. The LED luminaire of claim 1, wherein the length of the linearly extended non-metallic enclosure is at least 12 inches.

15. The LED luminaire of claim 1, wherein the linearly extended non-metallic enclosure is extruded with optical features.

16. A light emitting diode (LED) luminaire for producing at least 1000 lumens of visible light, comprising:

a linearly extended non-metallic enclosure having an interior volume formed by a single extruded piece having one or more sides and a light exiting portion along a length of the linearly extended non-metallic enclosure, wherein the one or more sides each comprises an inside surface and an outside surface, wherein at least a portion of the linearly extended non-metallic enclosure comprises an optically clear plastic;

one or more first LEDs mounted directly on the inside surface of one of the one or more sides of the linearly extended non-metallic enclosure via an interface material; and a reflector coupled to the interior volume of the linearly extended non-metallic enclosure, wherein the reflector redirects light from the one or more first LEDs, wherein the reflector is located between the one or more first LEDs and one or more second LEDs that are positioned on an opposing side of the linearly extended non-metallic enclosure relative to the one or more first LEDs, wherein the one or more sides of the linearly extended non-metallic enclosure enclose the one or more first LEDs, the reflector and the one or more second LEDs.

17. A method for producing a light emitting diode (LED) luminaire, comprising:

extruding a non-metallic material to form a linearly extended non-metallic enclosure that is a single extruded piece, wherein at least a portion of the non-metallic material is optically clear, wherein a cross-section of the linearly extended non-metallic enclosure does not change during the extruding, wherein the linearly extended non-metallic enclosure has an interior volume, one or more sides along a length of the linearly extended non-metallic enclosure, wherein one or more sides each comprises an inside surface and an outside surface;

cutting the linearly extended non-metallic enclosure after the extruding to a length of at least twelve inches to form a first open end and a second open end;

coupling one or more first LEDs directly to the inside surface of one of the one or more sides of the linearly extended non-metallic enclosure via an interface material;

coupling a reflector to the interior volume of the linearly extended non-metallic enclosure wherein the reflector is located between the one or more first LEDs and one or more second LEDs that are positioned on an opposing side of the linearly extended non-metallic enclosure relative to the one or more first LEDs, wherein the one or more sides of the linearly extended non-metallic enclosure enclose the one or more first LEDs, the reflector and the one or more second LEDs; and sealing the first open end with a first end cap and the second open end with a second end cap.

18. The method of claim 17, wherein the extruding further comprises:

forming one or more flanges; and forming one or more slots on the inside surface of the one or more sides to hold the reflector.

* * * * *